US007633030B2

(12) United States Patent
Chang

(10) Patent No.: US 7,633,030 B2
(45) Date of Patent: Dec. 15, 2009

(54) KEY STRUCTURE FOR PORTABLE ELECTRONIC DEVICES

(75) Inventor: Chia-Hsin Chang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 165 days.

(21) Appl. No.: 11/967,073

(22) Filed: Dec. 29, 2007

(65) Prior Publication Data

US 2009/0126428 A1 May 21, 2009

(30) Foreign Application Priority Data

Nov. 20, 2007 (CN) ..... 2007 1 0202606

(51) Int. Cl.
*H01H 3/12* (2006.01)

(52) U.S. Cl. ..... 200/341; 200/314

(58) Field of Classification Search ..... 200/310–314, 200/341–345

See application file for complete search history.

(56) References Cited

U.S. PATENT DOCUMENTS

| | | | | |
|---|---|---|---|---|
| 6,586,689 | B2 * | 7/2003 | Kuriyama | 200/6 A |
| 6,603,083 | B2 * | 8/2003 | Amari et al. | 200/5 D |
| 6,930,264 | B2 * | 8/2005 | Nagai et al. | 200/252 |
| 7,030,324 | B2 * | 4/2006 | Gotoh | 200/6 A |
| 7,176,393 | B1 * | 2/2007 | Lin et al. | 200/5 A |
| 7,235,754 | B2 * | 6/2007 | Rochon et al. | 200/406 |
| 7,449,654 | B2 * | 11/2008 | Tsuduki | 200/406 |
| 7,554,050 | B1 * | 6/2009 | Lv | 200/339 |

* cited by examiner

*Primary Examiner*—Michael A Friedhofer
*Assistant Examiner*—Lisa N Klaus
(74) *Attorney, Agent, or Firm*—Frank R. Niranjan

(57) ABSTRACT

A key structure (100) for a portable electronic device includes a housing (10) and a key (20). The housing has a receiving portion (142). The receiving portion defines an engaging groove (1446), and a width of the engaging groove from one end to another end is gradually varied. The key is engaged with the receiving portion of the housing. The key includes an elastic portion (22) received in the engaging groove. The elastic portion is movably received in the engaging groove.

15 Claims, 3 Drawing Sheets

KEY STRUCTURE FOR PORTABLE ELECTRONIC DEVICES

BACKGROUND OF THE INVENTION

1. Field of the Invention

The present invention relates generally to key structures, and particularly, to a key structure for a portable electronic device.

2. Discussion of the Related Art

With the development of wireless communication and information processing technologies, portable electronic devices such as mobile phones and personal digital assistants (PDAs) are now in widespread use, and consumers may now enjoy the full convenience of high technology products almost anytime and anywhere.

A portable electronic device usually includes side keys disposed at two sides thereof. Each side key conventionally includes a key portion and two elastic springs. The two elastic springs are respectively disposed at the bottom two sides of the key portion. These side keys may be pressed, and the elastic springs provide a return force so that the side key may resume an original state.

However, although each side key may realize an operation for a portable electronic device, two springs are required for assembly of the side key. The springs not only increase manufacture costs, but also complicate the assembly process of the side key. In addition, when the portable electronic device is carelessly dropped, the side keys can easily separates from the portable electronic device.

Therefore, an improved key structure is desired in order to overcome the above-described shortcomings.

SUMMARY OF THE INVENTION

One embodiment of a key structure of a portable electronic device includes a housing and a key. The housing has a receiving portion. The receiving portion defines an engaging groove, and a width of the engaging groove from one end to another end is gradually varied. The key is engaged with the receiving portion of the housing. The key includes an elastic portion received in the engaging groove. The elastic portion is movable received in the engaging groove.

Other advantages and novel features will become more apparent from the following detailed description when taken in conjunction with the accompanying drawings.

BRIEF DESCRIPTION OF THE DRAWINGS

Many aspects of the present key structure can be better understood with reference to the following drawings. The components in the drawings are not necessarily drawn to scale, the emphasis instead being placed upon clearly illustrating the principles of the key structure. Moreover, in the drawings, like reference numerals designate corresponding parts throughout the several views, in which.

DETAILED DESCRIPTION OF THE PREFERRED EMBODIMENTS

Figure 1:
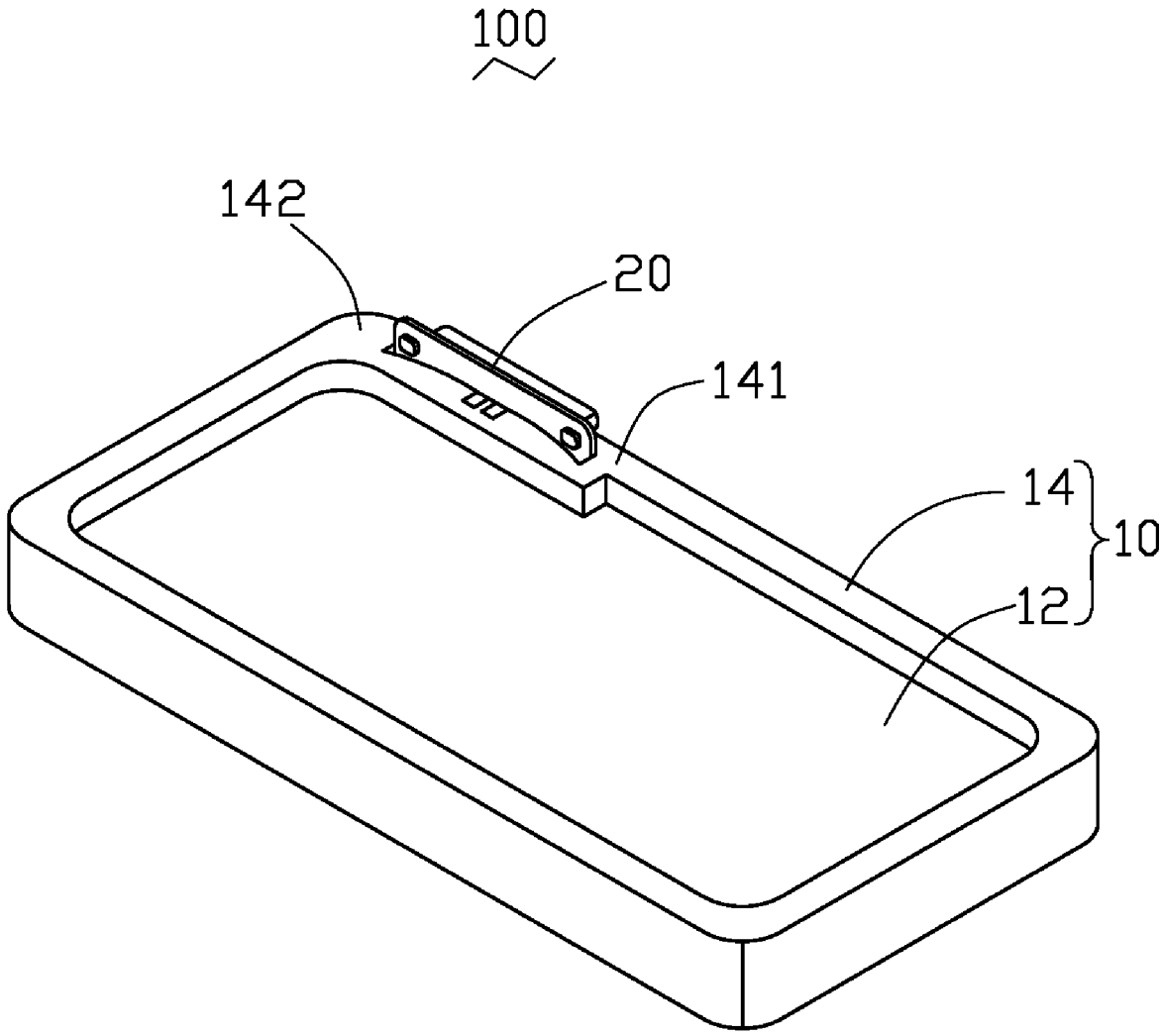
FIG. 1 is an assembled view of a key structure used for a portable electronic device.

The present key structure is used for a portable electronic device such as mobile phone, PDA and so on. Referring to FIG. 1, a key structure 100, includes a housing 10 and a key 20. The key 20 is disposed at one side of the housing 10. The key structure 100 is used for adjusting the volume of the portable electronic device.

Figure 2:
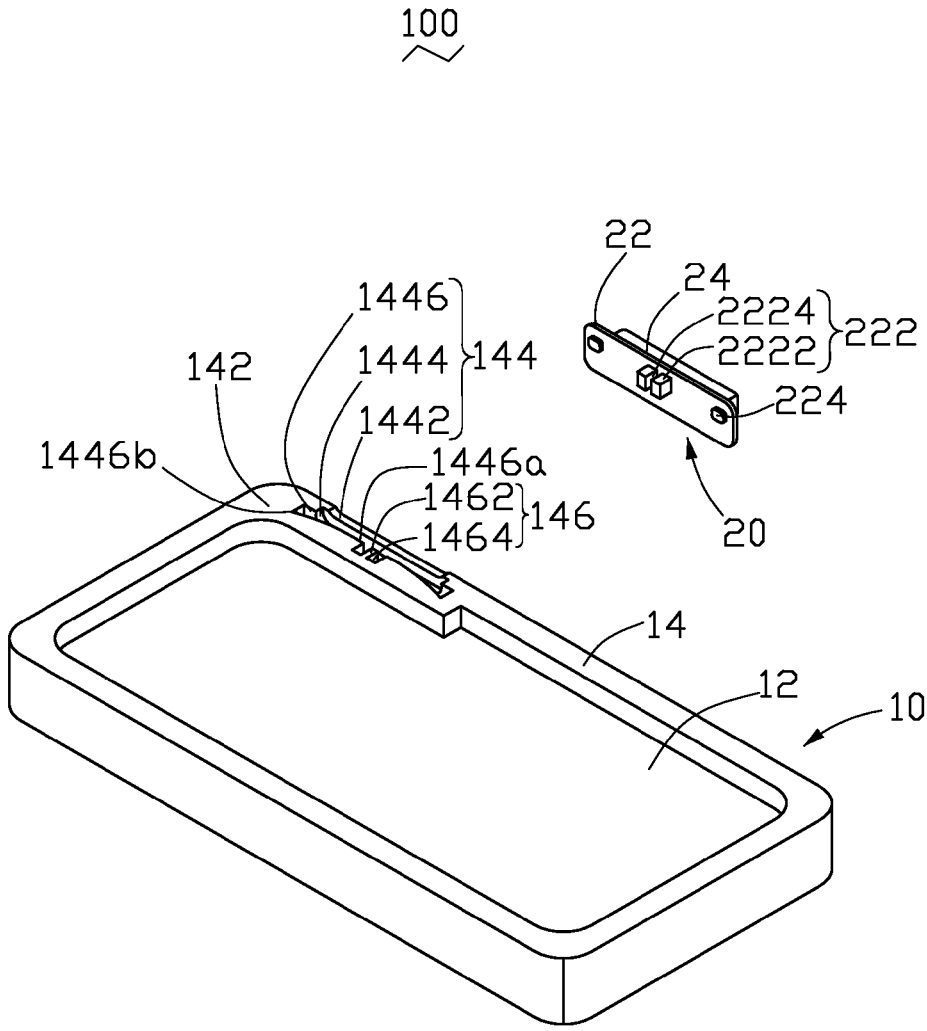
FIG. 2 is an exploded view of the key structure of FIG. 1.

Referring also to FIG. 2, the housing 10 is substantially rectangular, and includes a bottom wall 12, and four sidewalls 14 surrounding the bottom wall 12. The bottom wall 12 is configured for receiving electronic components thereon. The sidewalls 14 include a wall 141, which has a receiving portion 142. The receiving portion 142 intersects with the wall 141. A width of the receiving portion 142 is larger than that of the wall 141.

The receiving portion 142 defines an engaging groove 144, which includes a receiving groove 1442, a latching groove 1444 and an engaging groove 1446. The receiving groove 1442 is defined in a top surface of the receiving portion 142, and communicates with an outside of the housing 10. The latching groove 1444 is adjacent to the receiving groove 1442, and is in communication with the receiving groove 1442. A depth of the latching groove 1444 is deeper than that of the receiving groove 1442. The engaging groove 1446 is adjacent to the latching groove 1444, and is in communication with the latching groove 1444. A depth of the engaging groove 1446 is deeper than that of the latching groove 1444. The engaging groove 1446 includes a middle section 1446*a* and two end sections 1446*b*. A width of the engaging groove 1446 from the middle section 1446*a* to each end section 1446*b* is gradually increased, thereby substantially forming an arch shape. The receiving portion 142 further includes a latching portion 146. The latching portion 146 is disposed adjacent to the engaging groove 1446, and includes a protrusion 1462 and two slots 1464. The protrusion 1462 is formed between the two slots 1464. The two slots 1464 communicate with the engaging groove 1446.

The key 20 includes an elastic portion 22 and a press portion 24. The elastic portion 22 is made of rubber. A width of the elastic portion 22 matches that of the middle section 1446*a* of the engaging groove 1446. The elastic portion 22 disposes a locked portion 222 on one side thereof. The locked portion 222, in this embodiment, includes two blocks 2222 and a cutout 2224. The cutout 2224 is defined between the two blocks 2222. The blocks 2222 may respectively be received in a corresponding slot 1464, and the protrusion 1462 is received in the cutout 2224. The elastic portion 22 has two projections 224 respectively disposed at two sides of the locked portion 222. The projections 224 are used for resisting an inner switch in the housing 10 configured for controlling whether a circuit of the portable electronic device activates.

Figure 3:
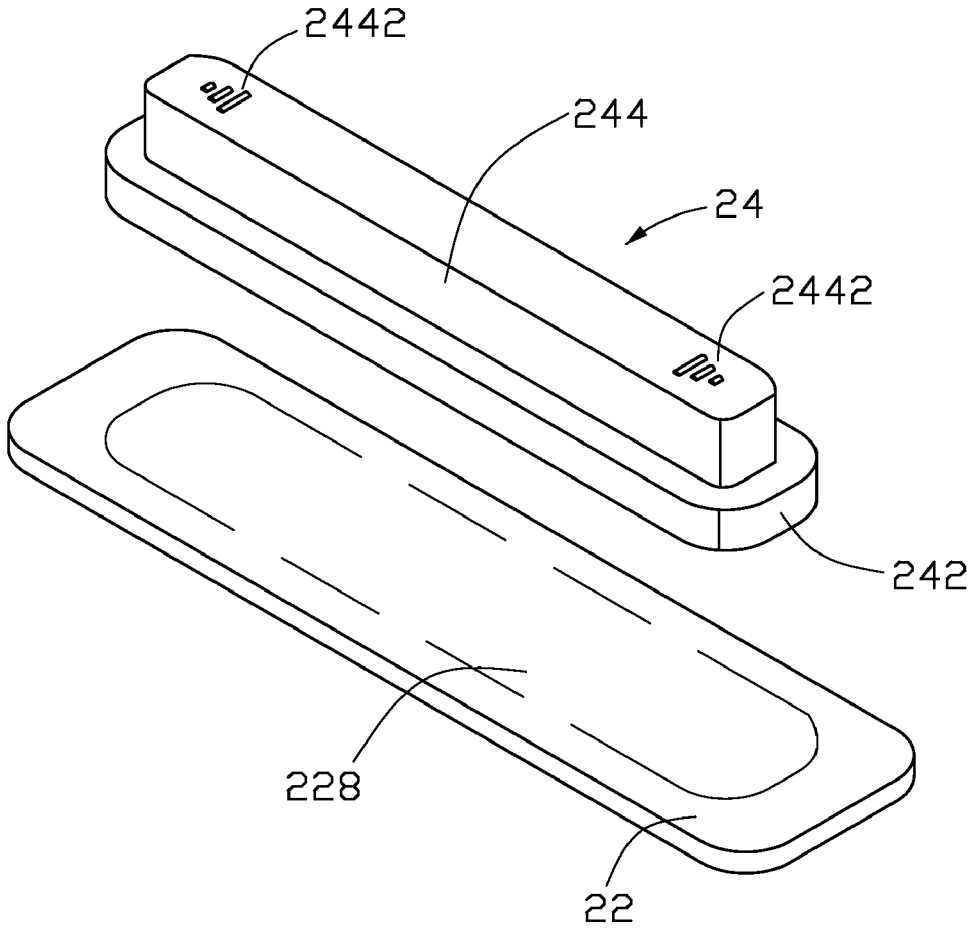
FIG. 3 is an exploded view of a key in FIG. 2.

Referring to FIG. 3, the elastic portion 22 has a connection area 228 configured for bonding the press portion 24. The press portion 24 is made of plastics, which includes a flange 242 and a body 244 integrally formed together. The flange 242 may be received in the latching groove 1444. The body 244 has two ribs 2442 formed at two sides thereof and are configured for pressing the key 20 so as to adjust the volume of the portable electronic device.

In assembly, the elastic portion 22 is inserted into the engaging groove 1446. A middle portion of the elastic portion 22 is engaged in the middle section 1446*a* of the engaging groove 1446, and two ends of the elastic portion 22 are received in the end sections 1446*b* of the engaging groove 1446. Two ends of the elastic portion 22 have a clearance with the engaging groove 1446. Accordingly, the ends of the elastic portion 22 may be moved in the engaging groove 1446. The blocks 2222 are received in a corresponding slot 1464, and the protrusion 1462 is received in the cutout 2224 so that the elastic portion 22 is locked in the housing 10. After that, the press portion 24 is placed in the latching groove 1444 and the receiving groove 1442. The flange 242 is received in the latching groove 1444, and the body 244 is received in the receiving groove 1442. Therefore, the assembled process of the key structure 100 is completed.

In use, the ribs 2442 of the press portion 24 are pressed. The press portion 24 further brings the elastic portion 22 to move. Since a movement space exists between two ends of the elastic portion 22 and two end sections 1446*b* of the engaging groove 1446. One end of the elastic portion 22 may move downward so that one of the projections 224 is electronically connected to an inner switch, thereby realizing the control of volume for the portable electronic device. The flange 2442 is engaged in the latching groove 1444, thereby preventing the key 20 being separated from the portable electronic device 100. When the press operation 24 is released, the rib 2442 returns to an original state under the elastic role of the elastic portion 22.

A main advantage of the key 20 is that the elastic portion 22 of the key 20 is integrally formed together. This may effectively reduce steps of the assembled process. In addition, the key assembled is stable owing the limitation of the grooves and is difficult to break away from the portable electronic device.

In alternative embodiments, the locked portion 222 of the elastic portion 22 and the latching portion 146 of the housing 10 may be replaced with other structures. Understandably, both of the press portion 24 and the elastic portion 22 may be integrally formed together, and are made of rubber. Alternatively, in order to increase the key stability, the flange 242 of the press portion 24 may be adhered to the elastic portion 22 with adhesive. The engaging groove may be in other shapes such as triangle, or a half-arch shape as long as a width of the engaging groove from one end to another end is gradually varied so as to allow the elastic portion to move therein.

As described above, the present embodiment provides a key structure for a portable electronic device, which has a simple structure. It is, however, to be understood that the key structure could potentially be useful in other applications in which it may be desirable to operate a key by pressing.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A key structure for a portable electronic device, comprising:

a housing having a receiving portion, the receiving portion defining an engaging groove, a width of the engaging groove from one end to another end being gradually varied; and a key being engaged with the receiving portion of the housing, the key including an elastic portion received in the engaging groove, the elastic portion being movably received in the engaging groove.

2. The key structure as claimed in claim 1, wherein the engaging groove includes a middle section and two end sections, and a width of the engaging groove from the middle section to each end section is gradually increased, thereby forming an arch shape.

3. The key structure as claimed in claim 1, wherein the receiving portion further comprises a receiving groove and a latching groove, the engaging groove, the receiving groove and the latching groove are adjacent to each other.

4. The key structure as claimed in claim 3, wherein the key further comprises a press portion, and the press portion includes a flange and a body, and the flange and the body are respectively engaged in the latching groove and the receiving groove.

5. The key structure as claimed in claim 1, wherein the elastic portion is made of rubber.

6. The key structure as claimed in claim 1, wherein the receiving portion further includes a latching portion, the elastic portion includes a locked portion, and the locked portion is configured for engaging with the latching portion.

7. The key structure as claimed in claim 6, wherein the latching portion includes a protrusion and two slots, and the protrusion is formed between the two slots.

8. The key structure as claimed in claim 7, wherein the locked portion includes two blocks and a cutout, and the blocks are respectively engaged in a corresponding slot, and the protrusion is received in the cutout.

9. The key structure as claimed in claim 1, wherein the elastic portion has two projections formed at two ends thereof, and is configured for electronically connected to an inner circuit of the housing.

10. A key structure for a portable electronic device, comprising:

a housing having a receiving portion, the receiving portion defining an engaging groove with a middle section and two end sections, a width of the engaging groove from the middle section to each end section being gradually increased; and a key being engaged with the receiving portion of the housing, the key including an elastic portion received in the engaging groove, two ends of the elastic portion being spaced from the two end sections of the engaging groove configured for being movably in the engaging groove.

11. The key structure as claimed in claim 10, wherein the receiving portion further comprises a receiving groove and a latching groove, the engaging groove, the receiving groove and the latching groove are adjacent to each other.

12. The key structure as claimed in claim 11, wherein the key further comprises a press portion, and the press portion includes a flange and a body, and the flange and the body are respectively engaged in the latching groove and the receiving groove.

13. The key structure as claimed in claim 10, wherein the receiving portion further includes a latching portion, the elastic portion includes a locked portion, and the locked portion is configured for engaging with the latching portion.

14. The key structure as claimed in claim 13, wherein the latching portion includes a protrusion and two slots, and the protrusion is disposed between the two slots.

15. The key structure as claimed in claim 14, wherein the locked portion includes two blocks and a cutout, and the blocks are respectively engaged in a corresponding slot, and the protrusion is received in the cutout.

* * * * *